US011964800B1

(12) United States Patent
Li

(10) Patent No.: US 11,964,800 B1
(45) Date of Patent: Apr. 23, 2024

(54) CONTAINER LID AND CONTAINER

(71) Applicant: Guangcheng Li, Guangzhou (CN)

(72) Inventor: Guangcheng Li, Guangzhou (CN)

( * ) Notice: Subject to any disclaimer, the term of this patent is extended or adjusted under 35 U.S.C. 154(b) by 0 days.

(21) Appl. No.: 18/487,036

(22) Filed: Oct. 13, 2023

(30) Foreign Application Priority Data

Sep. 22, 2023 (CN) ..... 202322601410.9

(51) Int. Cl.
*B65D 43/06* (2006.01)
*B65D 43/02* (2006.01)

(52) U.S. Cl.
CPC ..... *B65D 43/065* (2013.01); *B65D 43/0202* (2013.01); *B65D 2543/00194* (2013.01); *B65D 2543/00305* (2013.01); *B65D 2543/00555* (2013.01); *B65D 2543/0099* (2013.01)

(58) Field of Classification Search
CPC .... B65D 43/065; B65D 43/06; B65D 43/021; B65D 43/0218; B65D 43/0214; B65D 43/0202; B65D 43/02; B65D 2543/0099; B65D 2543/00953; B65D 2543/00555; B65D 2543/00194; B65D 2543/00175; B65D 2543/0012; B65D 2543/00305; B65D 2543/00259
USPC ..... 220/790, 789, 783, 780, 803, 802, 805, 220/804, 801, 796
See application file for complete search history.

(56) References Cited

U.S. PATENT DOCUMENTS 2,833,324 A * 5/1958 Burroughs ..... B65D 43/0212 215/320
2,857,947 A * 10/1958 Powers ..... B65D 43/0218 220/799
3,149,747 A * 9/1964 Burgess ..... B65D 43/0204 D13/184
3,335,774 A * 8/1967 Reed ..... B65D 43/0208 220/790
3,487,972 A * 1/1970 Swett ..... B65D 43/0218 220/555
3,817,420 A * 6/1974 Heisler ..... B65D 43/0208 220/276
2023/0373692 A1* 11/2023 Chisholm ..... B65D 51/1688

FOREIGN PATENT DOCUMENTS

JP 2011037446 A * 2/2011 ..... B65D 43/10
WO WO-9509115 A1 * 4/1995 ..... B65D 25/54

* cited by examiner

*Primary Examiner* — Robert J Hicks

(57) ABSTRACT

The present invention provides a container lid. The container lid includes a lid main body. The lid main body includes a top wall, a first elastic side wall extending from the top wall, and a second elastic side wall extending from the top wall. The first elastic side wall and the second elastic side wall are encircled to form a sealing groove. The sealing groove is provided with a groove opening. The sealing groove is configured to press and seal a container opening. Through the above structure, the container opening can be sealed through the sealing groove. Specifically, the first elastic side wall presses and seals an inner side wall of the container opening, and the second elastic side wall presses and seals an outer side wall of the container opening.

19 Claims, 6 Drawing Sheets

CONTAINER LID AND CONTAINER

CROSS-REFERENCE TO RELATED APPLICATIONS

The application claims priority of Chinese patent application CN2023226014109, filed on Sep. 22, 2023, which is incorporated herein by reference in its entireties.

TECHNICAL FIELD

The present disclosure relates to the field of containers, and particularly, to a container lid and a container.

BACKGROUND

As a tool for daily storage of goods, containers are usually used by users to store solid or liquid food, and container openings are closed through container lids to prevent foreign matters from entering the food in the containers. However, the existing container lids on the market can only play a role of closing the container opening, and do not have an effect of sealing the container opening. Liquid in the container would often seep out through the container opening and the container lid. Furthermore, the odor of the food in the container would also be diffused to the environment through the opening and the lid. For example, when the container is placed in a refrigerator, the odor diffused into the refrigerator through the opening and the lid would pollute the refrigerator. If multiple pieces of food are placed together, the taste of the food is easily tainted by another odor. Therefore, there is an urgent need to provide a container lid and a container with a good sealing effect on the market to improve the user experience.

SUMMARY

In order to overcome the shortcomings of the prior art, the present disclosure provides a container lid. The container lid includes a lid main body, wherein the lid main body includes a top wall, a first elastic side wall extending from the top wall, and a second elastic side wall extending from the top wall; the first elastic side wall and the second elastic side wall are encircled to form a sealing groove; the sealing groove is provided with a groove opening; the sealing groove is configured to press and seal a container opening.

As the improvement of the present disclosure, a protruding height of the second elastic side wall is greater than or equal to a protruding height of the first elastic side wall.

As the improvement of the present disclosure, when the lid main body is covered at the container opening of a container main body, an inner wall of the second elastic side wall of the lid main body is in contact with an outer wall of the container main body, and an outer wall of the first elastic side wall of the lid main body is in contact with an inner wall of the container main body, so as to seal the container opening of the container main body.

As the improvement of the present disclosure, the first elastic side wall and/or the second elastic side wall are provided with several elastic sealing raised lines, and the sealing raised lines are located in the sealing groove; and the sealing raised lines are configured to press and seal the container opening.

As the improvement of the present disclosure, the first elastic side wall is provided with a first upper side portion, a first middle portion, and a first lower side portion; the first upper side portion is connected to the top wall; the first middle portion is located between the first upper side portion and the first lower side portion; the second elastic side wall is provided with a second upper side portion, a second middle portion, and a second lower side portion; the second upper side portion is connected to the top wall; the second middle portion is located between the second upper side portion and the second lower side portion.

As the improvement of the present disclosure, a first spacing is reserved between the first upper side portion of the first elastic side wall and the second upper side portion of the second elastic side wall; a second spacing is reserved between the first middle portion of the first elastic side wall and the second middle portion of the second elastic side wall; and the first spacing is greater than the second spacing.

As the improvement of the present disclosure, a third spacing is reserved between the first lower side portion of the first elastic side wall and the second lower side portion of the second elastic side wall, and the third spacing is greater than the second spacing.

As the improvement of the present disclosure, the top wall is provided with an upper surface and a lower surface; the first elastic side wall and the second elastic side wall are connected to the lower surface; the upper surface is sunken towards the lower surface to form an accommodating slot; and the accommodating slot is configured to accommodate a container.

As the improvement of the present disclosure, the lid main body is a silica gel lid main body or a rubber lid main body.

As the improvement of the present disclosure, the first elastic side wall and the second elastic side wall are arranged in sequence in a direction from the center portion of the lid main body towards an edge portion of the lid main body.

As the improvement of the present disclosure, a thickness of the first upper side portion is a first thickness; a thickness of the first lower side portion is a second thickness; and the second thickness is less than the first thickness.

As the improvement of the present disclosure, a cross section of the first elastic side wall is in a V shaped with a wide top and a narrow bottom.

As the improvement of the present disclosure, a thickness of the second upper side portion is a third thickness; a thickness of the second lower side portion is a fourth thickness; and the fourth thickness is greater than the first thickness.

As the improvement of the present disclosure, the first lower side portion is provided with a first guide surface; and the second lower side portion is provided with a second guide surface.

As the improvement of the present disclosure, the first guide surface is a cambered guide surface, and the second guide surface is an inclined guide surface.

As the improvement of the present disclosure, each sealing raised line has a left side and a right side; the right side is connected to the first elastic side wall or the second elastic side wall; and the left side is configured to press and seal the container opening.

As the improvement of the present disclosure, the left side has a fifth thickness; the right side has a sixth thickness; and the fifth thickness is less than the sixth thickness.

As the improvement of the present disclosure, there are two sealing raised lines.

As the improvement of the present disclosure, the lid main body is a silica gel lid main body.

The present disclosure also provides a container, including: a container main body, wherein a side wall of the container main body is encircled to form an accommodating cavity; an upper end wall of the container main body is provided with a container opening; the container opening is communicated to the accommodating cavity; and a lid main body, wherein the lid main body includes a top wall, a first elastic side wall extending from the top wall, and a second elastic side wall extending from the top wall; the first elastic side wall and the second elastic side wall are encircled to form a sealing groove; the sealing groove is provided with a groove opening, wherein when the upper end wall of the container main body is placed in the sealing groove, the lid main body is covered at the container opening; and an inner wall of the sealing groove presses and seals the upper end wall of the container main body, so that the sealing groove presses and seals the container opening.

As the improvement of the present disclosure, the first elastic side wall is provided with a first upper side portion, a first middle portion, and a first lower side portion; the first upper side portion is connected to the top wall; the first middle portion is located between the first upper side portion and the first lower side portion; the second elastic side wall is provided with a second upper side portion, a second middle portion, and a second lower side portion; the second upper side portion is connected to the top wall; the second middle portion is located between the second upper side portion and the second lower side portion; a first spacing is reserved between the first upper side portion of the first elastic side wall and the second upper side portion of the second elastic side wall; a second spacing is reserved between the first middle portion of the first elastic side wall and the second middle portion of the second elastic side wall; the first spacing is greater than the second spacing; a third spacing is reserved between the first lower side portion of the first elastic side wall and the second lower side portion of the second elastic side wall, and the third spacing is greater than the second spacing; the upper end wall is provided with a third upper side portion, a third middle portion, and a third lower side portion; the third middle portion is located between the third upper side portion and the third lower side portion; when the upper end wall of the container main body is placed in the sealing groove, the third upper side portion is located between the first upper side portion and the second upper side portion; an overflow gap is reserved between the third upper side portion and the first upper side portion and/or the second upper side portion; the third middle portion is located between the first middle portion and the second middle portion; the first middle portion and the second middle portion press and seal the third middle portion; and the third lower side portion is located between the first lower side portion and the second lower side portion.

As the improvement of the present disclosure, the lid main body is a silica gel lid main body or a rubber lid main body, and a hardness range of the lid main body is 30-80 Shore A.

Beneficial effects of the present disclosure are as follows: The present disclosure provides a container lid. The container lid includes a lid main body, wherein the lid main body includes a top wall, a first elastic side wall extending from the top wall, and a second elastic side wall extending from the top wall; the first elastic side wall and the second elastic side wall are encircled to form a sealing groove; the sealing groove is provided with a groove opening; and the sealing groove is configured to press and seal a container opening. Through the above structure, the container opening can be sealed through the sealing groove. Specifically, the first elastic side wall presses and seals an inner side wall of the container opening, and the second elastic side wall presses and seals an outer side wall of the container opening, so as to effectively prevent liquid and odor in the container from seeping out of the container via the inner side wall or the outer side wall of the container opening.

BRIEF DESCRIPTION OF THE DRAWINGS

In order to explain the technical solutions of the embodiments of the present disclosure more clearly, the following will briefly introduce the accompanying drawings used in the embodiments. The drawings in the following description are only some embodiments of the present disclosure. Those of ordinary skill in the art can obtain other drawings based on these drawings without creative work.

The present disclosure is further described below in detail in combination with the accompanying drawings and embodiments.

DETAILED DESCRIPTION OF THE EMBODIMENTS

Figure 1:
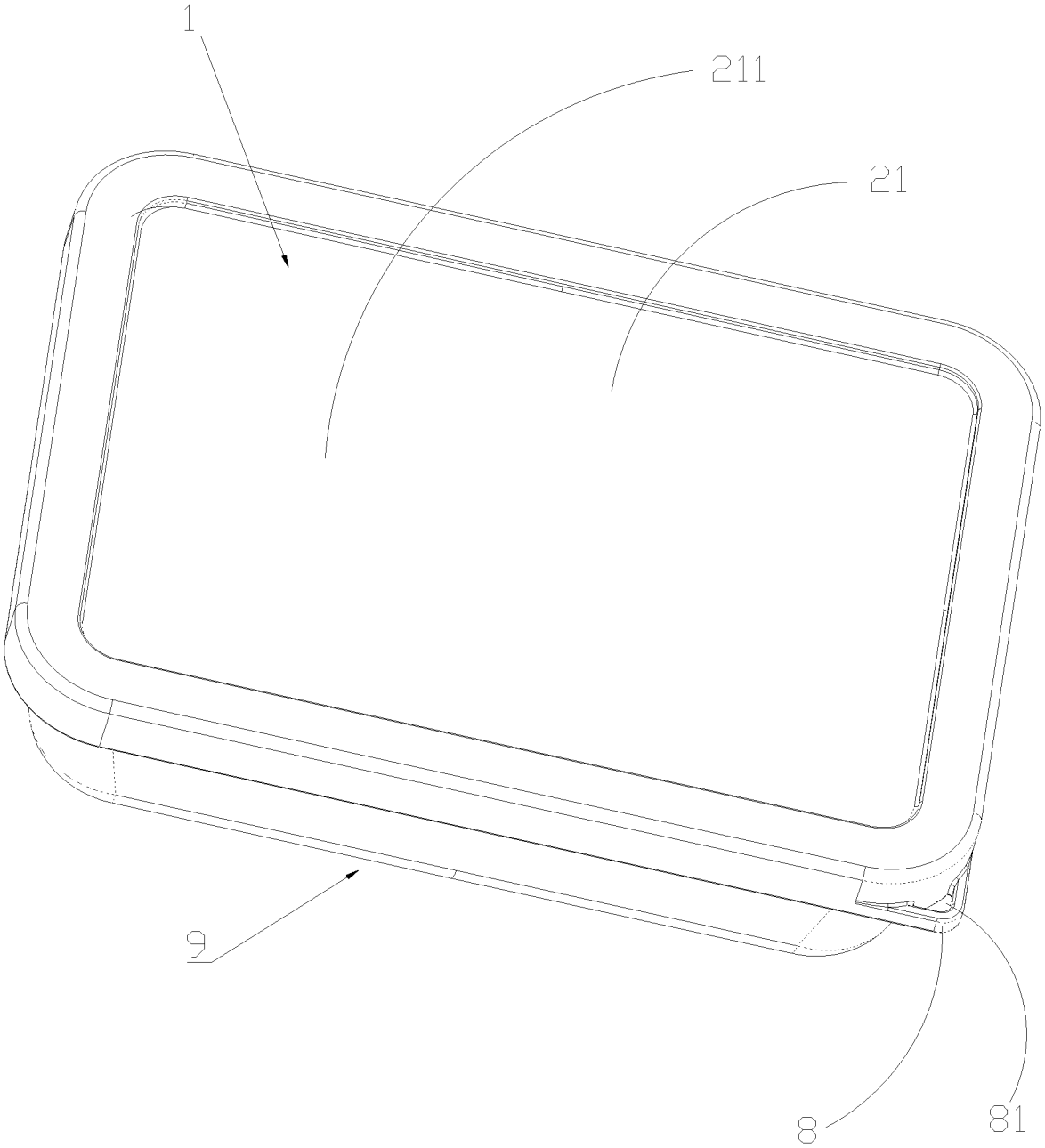
FIG. 1 is a schematic diagram of an entire structure of the present disclosure.
Figure 2:
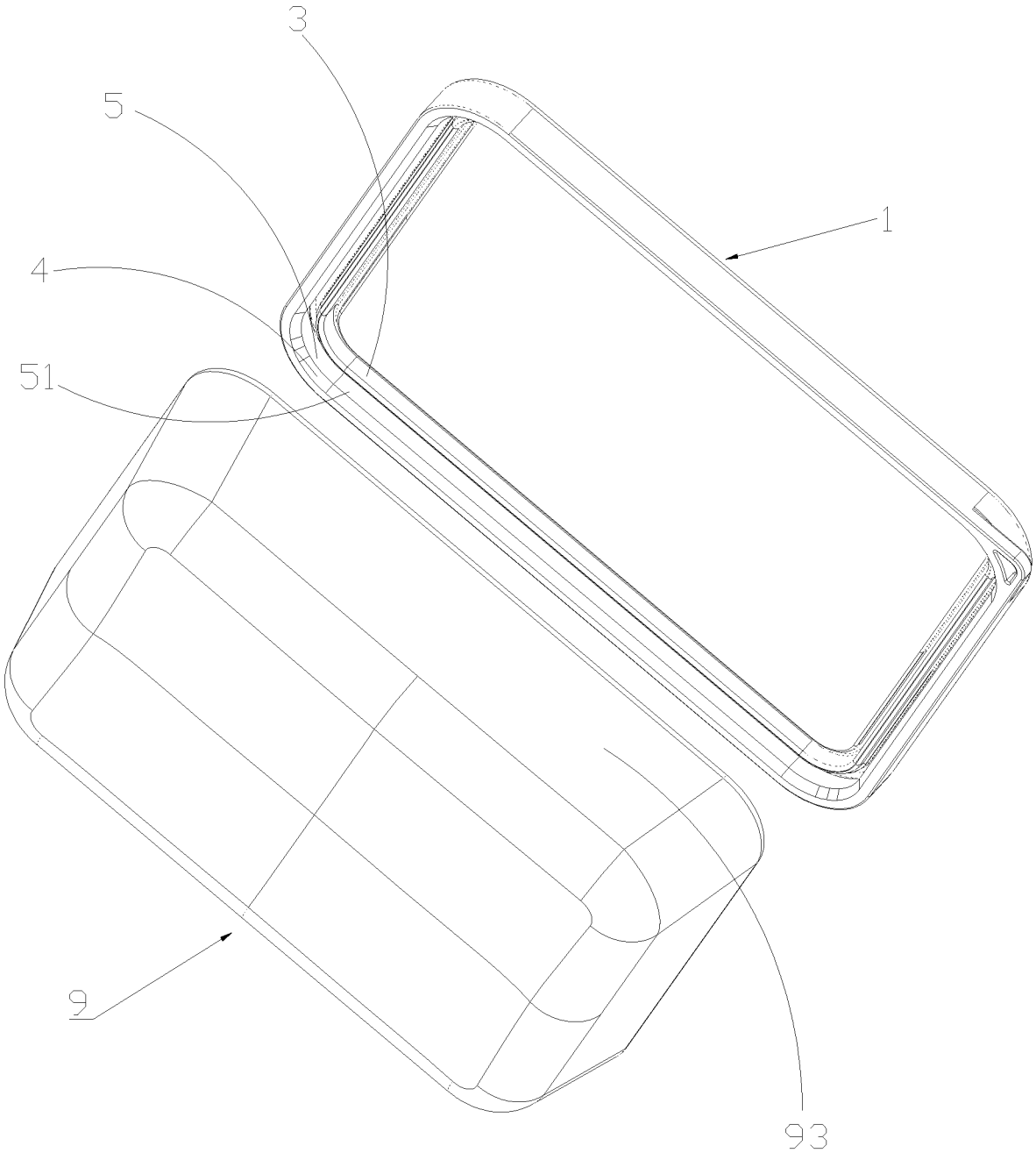
FIG. 2 is an exploded view of the present disclosure.
Figure 3:
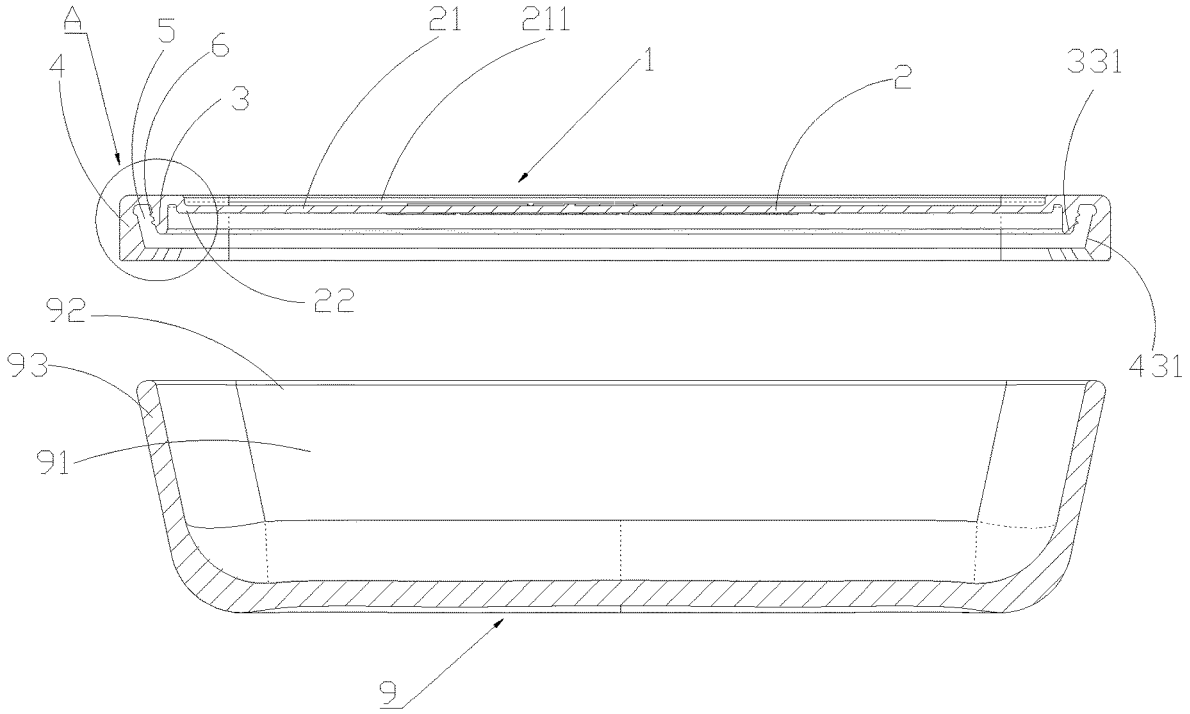
FIG. 3 is a sectional view cut away along a first side wall, a second side wall, and a sealing groove.
Figure 4:
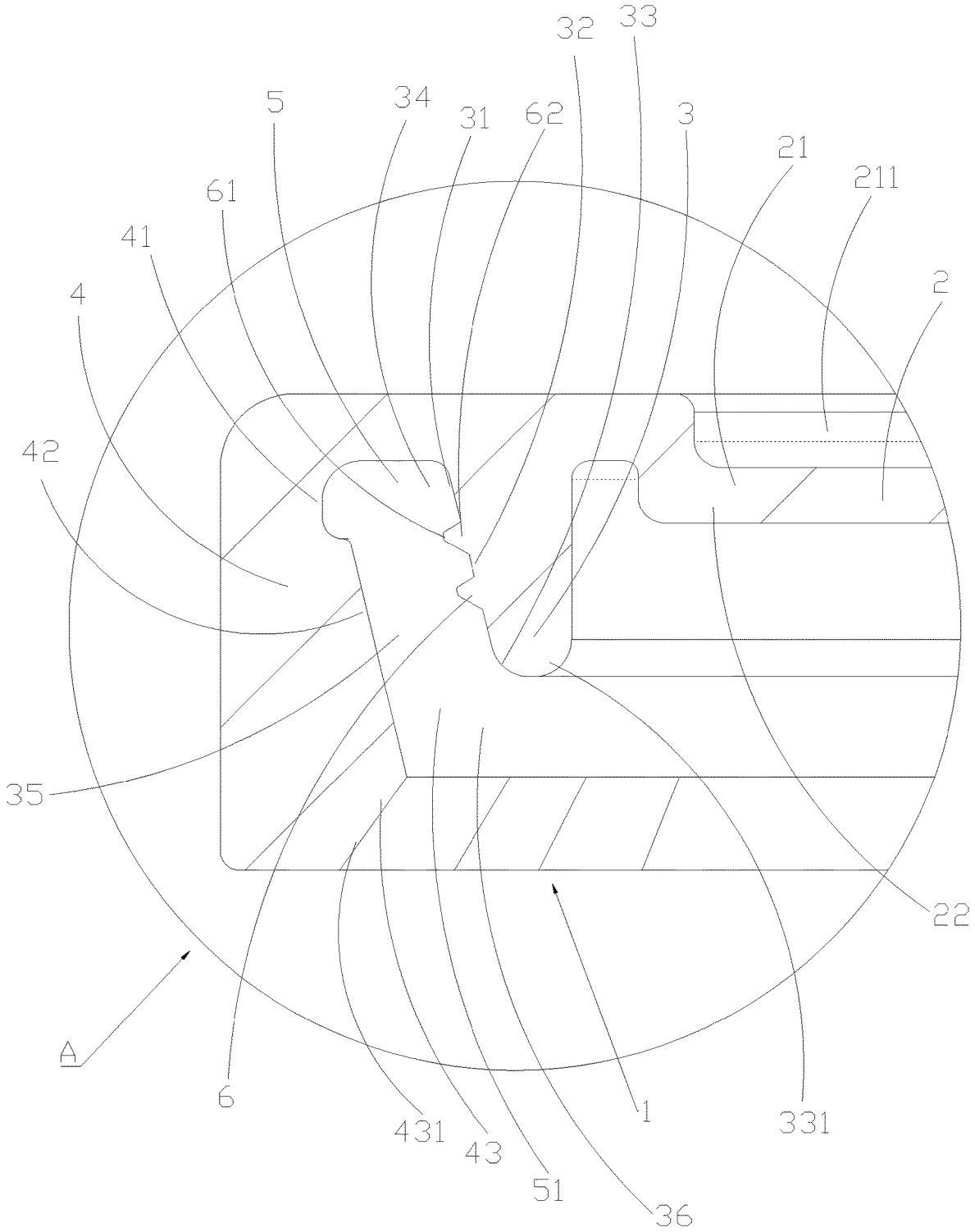
FIG. 4 is an enlarged view of portion A in FIG. 3.
Figure 5:
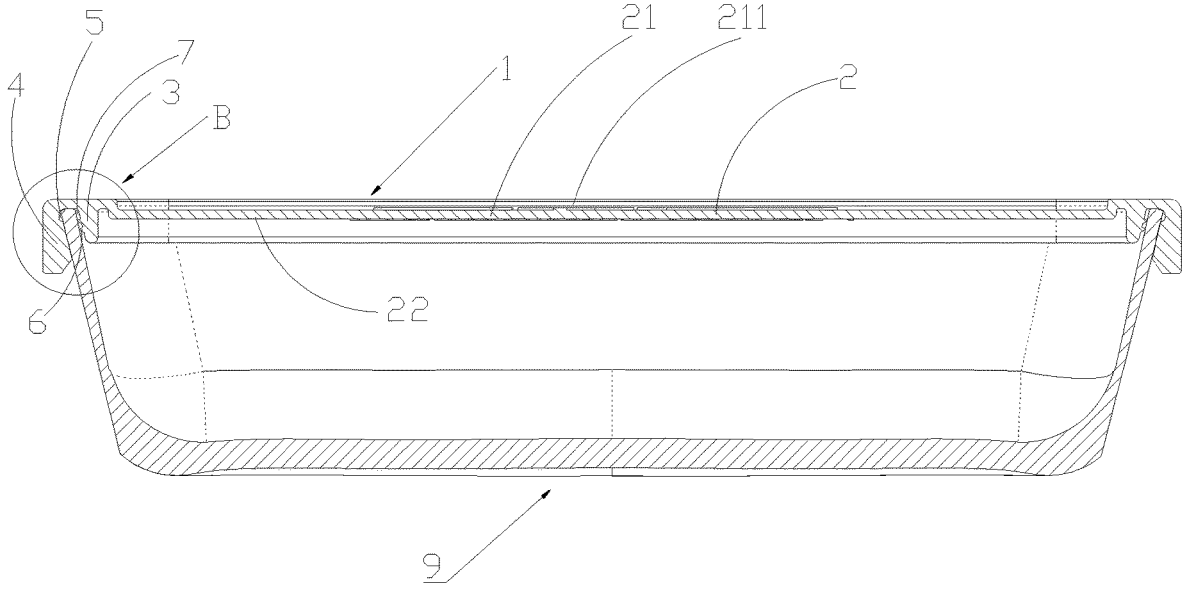
FIG. 5 is another sectional view cut away along a first side wall, a second side wall, and a sealing groove.
Figure 6:
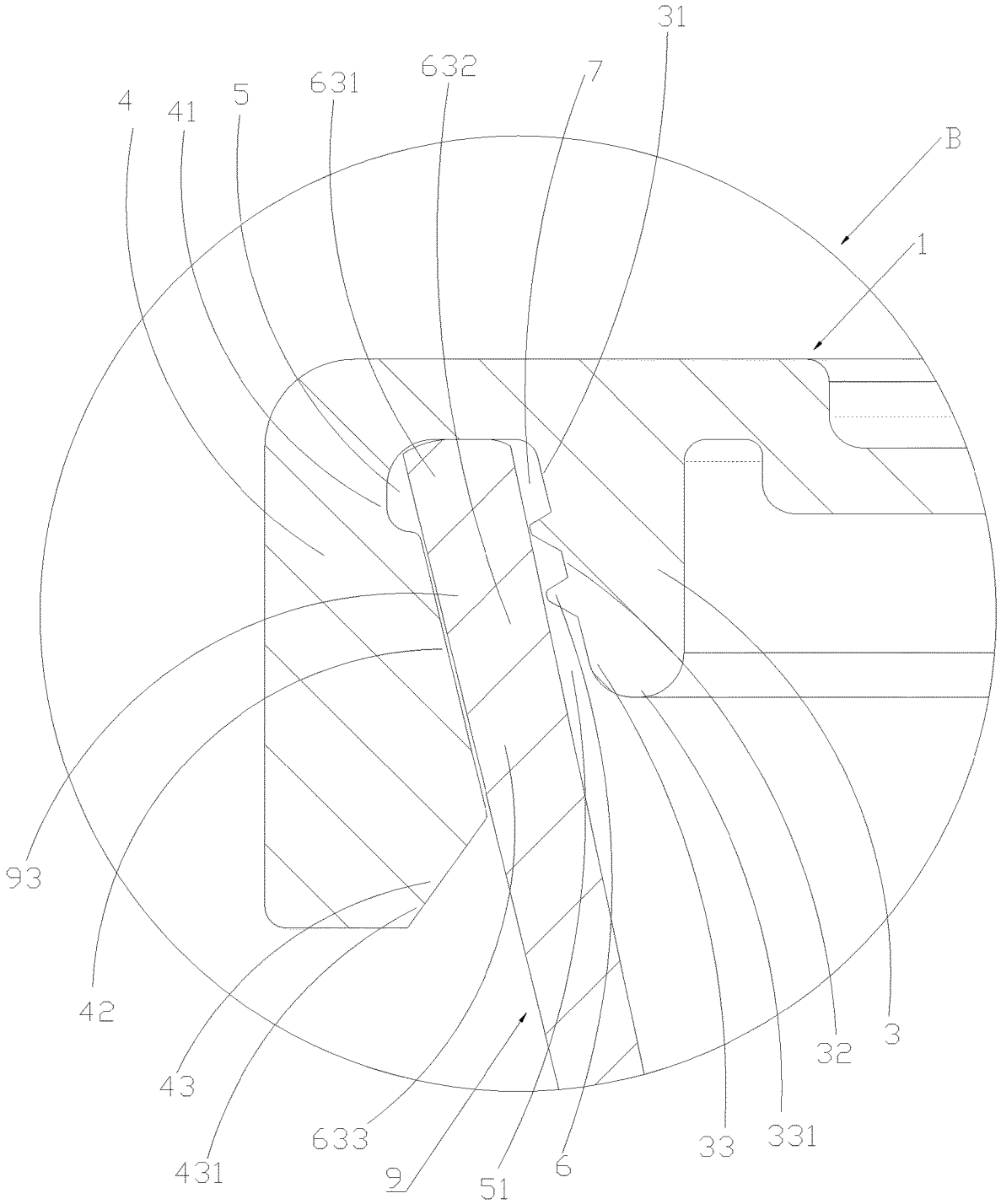
FIG. 6 is an enlarged view of portion B in FIG. 5.

Referring to FIG. 1 to FIG. 6, a container lid includes:

a lid main body 1, wherein the lid main body 1 includes a top wall 2, a first elastic side wall 3 extending from the top wall 2, and a second elastic side wall 4 extending from the top wall 2; the first elastic side wall 3 and the second elastic side wall 3 are encircled to form a sealing groove 5; the sealing groove 5 is provided with a groove opening 51; and the sealing groove 5 is configured to press and seal a container opening 92. Through the above structure, the container opening can be sealed through the sealing groove. Specifically, the first elastic side wall presses and seals an inner side wall of the container opening, and the second elastic side wall presses and seals an outer side wall of the container opening, so as to effectively prevent liquid and odor in the container from seeping out of the container via the inner side wall or the outer side wall of the container opening.

The sealing groove is an annular sealing groove arranged around the lid main body. The first elastic side wall is an annular first elastic side wall arranged around the lid main body; and the second elastic side wall is the second elastic side wall arranged around the ring shaped lid main body.

In this embodiment, a protruding height of the second elastic side wall 4 is greater than or equal to a protruding height of the first elastic side wall 3.

In this embodiment, when the lid main body 1 is covered at the container opening 92 of a container main body 9, an inner wall of the second elastic side wall 4 of the lid main body 1 is in contact with an outer wall of the container main body 9, and an outer wall of the first elastic side wall 3 of the lid main body 1 is in contact with an inner wall of the container main body 9, so as to seal the container opening 92 of the container main body 9.

In this embodiment, the first elastic side wall 3 and/or the second elastic side wall 4 are provided with several elastic sealing raised lines 6, and the sealing raised lines 6 are located in the sealing groove 5; and the sealing raised lines 6 are configured to press and seal the container opening 92. There are two sealing raised lines 6. Specifically, each sealing raised line 6 has a left side 61 and a right side 62; the right side 62 is connected to the first elastic side wall 3 or the second elastic side wall 4; and the left side 61 is configured to press and seal the container opening 92. Further, the left side 61 has a fifth thickness; the right side 62 has a sixth thickness; and the fifth thickness is less than the sixth thickness. Through the above structure, the sealing raised lines arranged in the sealing groove can provide a higher elastic pressing force to further press and seal the container opening.

In this embodiment, the first elastic side wall 3 is provided with a first upper side portion 31, a first middle portion 32, and a first lower side portion 33; the first upper side portion 31 is connected to the top wall 2; the first middle portion 32 is located between the first upper side portion 31 and the first lower side portion 33; the second elastic side wall 4 is provided with a second upper side portion 41, a second middle portion 42, and a second lower side portion 43; the second upper side portion 41 is connected to the top wall 2; and the second middle portion 42 is located between the second upper side portion 41 and the second lower side portion 43. A first spacing 34 is reserved between the first upper side portion 31 of the first elastic side wall 3 and the second upper side portion 41 of the second elastic side wall 4; a second spacing 35 is reserved between the first middle portion 32 of the first elastic side wall 3 and the second middle portion 42 of the second elastic side wall 4; and the first spacing 34 is greater than the second spacing 35. Specifically, a third spacing 36 is reserved between the first lower side portion 33 of the first elastic side wall 3 and the second lower side portion 43 of the second elastic side wall 4, and the third spacing 36 is greater than the second spacing 35. Further, the first lower side portion 33 is provided with a first guide surface 331; and the second lower side portion 43 is provided with a second guide surface 431. Further, the first guide surface 331 is a cambered guide surface, and the second guide surface 431 is an inclined guide surface. Through the above structure, as the first spacing is greater than the second spacing, when an upper end wall of the container main body 9 is arranged in the sealing groove 5, the first middle portion and the second middle portion press against a middle portion of the upper end wall of the container main body to seal the container opening. An upper side portion of the upper end wall of the container is located between the first upper side portion 31 and the second upper side portion 41, and an overflow gap 7 is reserved between a third upper side portion 631 and the first upper side portion 31 and/or the second upper side portion 41, so that even if a little of liquid overflows via a gap between the sealing groove and an inner wall of the opening, the liquid will stay in the overflow gap and be prevented from overflowing out of the container. Moreover, as the third spacing is greater than the second spacing, and the first lower side portion 33 is provided with the first guide surface 331, and the second lower side portion 43 is provided with a second guide surface 431, which facilitates a user to guide the upper end wall into the sealing groove.

In this embodiment, the top wall 2 is provided with an upper surface 21 and a lower surface 22; the first elastic side wall 3 and the second elastic side wall 4 are connected to the lower surface 22; the upper surface 21 is sunken towards the lower surface 22 to form an accommodating slot 211; and the accommodating slot 211 is configured to accommodate the container. Through the structure, when there are several containers, other containers can be placed in the accommodating slot to complete stacking of the containers.

In this embodiment, the lid main body 1 is a silica gel lid main body 1 or a rubber lid main body 1. The first elastic side wall and the second elastic side wall are both made of a silica gel material. Through the above structure, silica gel is soft and has good elasticity. The first elastic sidewall and the second elastic side wall which are made of the silica gel material can better press and seal the opening, which further improves the sealing performance of the lid.

The first elastic side wall 3 and the second elastic side wall 4 are arranged in sequence in a direction from the center portion of the lid main body 1 towards an edge portion of the lid main body 1. Through the above structure, the design is reasonable, the structure is simple and compact, and the arrangement of the first elastic side wall and the second elastic side wall is effectively achieved.

In this embodiment, a thickness of the first upper side portion 31 is a first thickness; a thickness of the first lower side portion 33 is a second thickness; and the second thickness is less than the first thickness. A cross section of the first elastic side wall 3 is in a V shaped with a wide top and a narrow bottom. Specifically, a thickness of the second upper side portion 41 is a third thickness; a thickness of the second lower side portion 43 is a fourth thickness; and the fourth thickness is greater than the first thickness. Through the above structure, the arrangement of the first elastic side wall and the second elastic side wall is effectively achieved, which further improves the sealing effect of the sealing groove on the container opening.

Referring to FIG. 1 to FIG. 6, a container is further provided, including:

a container main body 9, wherein a side wall of the container main body 9 is encircled to form an accommodating cavity 91; an upper end wall 93 of the container main body 9 is provided with a container opening 92; the container opening 92 is communicated to the accommodating cavity 91; and a lid main body 1, wherein the lid main body 1 includes a top wall 2, a first elastic side wall 3 extending from the top wall 2, and a second elastic side wall 4 extending from the top wall 2; the first elastic side wall 3 and the second elastic side wall 4 are encircled to form a sealing groove 5; and the sealing groove 5 is provided with a groove opening 51.

When the upper end wall 93 of the container main body 9 is placed in the sealing groove 5, the lid main body 1 is covered at the container opening 92; and an inner wall of the sealing groove 5 presses and seals the upper end wall 93 of the container main body 9, so that the sealing groove 5 presses and seals the container opening 92.

Through the above structure, the container opening can be sealed through the sealing groove. Specifically, the first elastic side wall presses and seals an inner side wall of the container opening, and the second elastic side wall presses and seals an outer side wall of the container opening, so as to effectively prevent liquid and odor in the container from seeping out of the container via the inner side wall or the outer side wall of the container opening.

The first elastic side wall 3 is provided with a first upper side portion 31, a first middle portion 32, and a first lower side portion 33; the first upper side portion 31 is connected to the top wall 2; the first middle portion 32 is located between the first upper side portion 31 and the first lower side portion 33; the second elastic side wall 4 is provided with a second upper side portion 41, a second middle portion 42, and a second lower side portion 43; the second upper side portion 41 is connected to the top wall 2; the second middle portion 42 is located between the second upper side portion 41 and the second lower side portion 43; a first spacing 34 is reserved between the first upper side portion 31 of the first elastic side wall 3 and the second upper side portion 41 of the second elastic side wall 4; a second spacing 35 is reserved between the first middle portion 32 of the first elastic side wall 3 and the second middle portion 42 of the second elastic side wall 4; the first spacing 34 is greater than the second spacing 35; a third spacing 36 is reserved between the first lower side portion 33 of the first elastic side wall 3 and the second lower side portion 43 of the second elastic side wall 4; and the third spacing 36 is greater than the second spacing 35. The upper end wall 93 is provided with a third upper side portion 631, a third middle portion 632, and a third lower side portion 633; the third middle portion 632 is located between the third upper side portion 631 and the third lower side portion 633; when the upper end wall of the container main body 9 is placed in the sealing groove 5, the third upper side portion 631 is located between the first upper side portion 31 and the second upper side portion 41; an overflow gap 7 is reserved between the third upper side portion 631 and the first upper side portion 31 and/or the second upper side portion 41; the third middle portion 632 is located between the first middle portion 32 and the second middle portion 42; the first middle portion 32 and the second middle portion 42 press and seal the third middle portion 632; and the third lower side portion 633 is located between the first lower side portion 33 and the second lower side portion 43. Through the above structure, even if a little of liquid overflows via a gap between the sealing groove and an inner wall of the opening, the liquid will stay in the overflow gap and be prevented from overflowing out of the container. Moreover, as the third spacing is greater than the second spacing, and the first lower side portion 33 is provided with the first guide surface 331, and the second lower side portion 43 is provided with a second guide surface 431, which facilitates a user to guide the upper end wall into the sealing groove.

In this embodiment, the lid main body is further provided with a lift portion (8), configured to be used by a user to lift the lid. The lift portion (8) is provided with a notch (81), and the user can lift the lid more easily through the notch.

The container main body can be a glass bowl, or a glass bottle or a container main body made of another material.

In this embodiment, the lid main body is a silica gel lid main body or a rubber lid main body, and a hardness range of the lid main body is 30-80 Shore A.

One or more implementation modes are provided above in combination with specific contents, and it is not deemed that the specific implementation of the present disclosure is limited to these specifications. Any technical deductions or replacements approximate or similar to the method and structure of the present disclosure or made under the concept of the present disclosure shall fall within the scope of protection of the present disclosure.

What is claimed is:

1. A container lid, comprising:

a lid main body, wherein the lid main body comprises a top wall, a first elastic side wall extending from side edges of the top wall, and a second elastic side wall extending from the side edges of the top wall; the first elastic side wall and the second elastic side wall are encircled to form a sealing groove; the sealing groove is provided with a groove opening; the sealing groove is configured to press and seal a container opening;

wherein the first elastic side wall and/or the second elastic side wall are provided with two elastic sealing raised lines, and the sealing raised lines are located in the sealing groove; and the sealing raised lines are configured to press and seal the container opening.

2. The container lid according to claim 1, wherein a protruding height of the second elastic side wall is greater than or equal to a protruding height of the first elastic side wall.

3. The container lid according to claim 1, wherein when the lid main body is covered at the container opening of a container main body, an inner wall of the second elastic side wall of the lid main body is in contact with an outer wall of the container main body, and an outer wall of the first elastic side wall of the lid main body is in contact with an inner wall of the container main body, so as to seal the container opening of the container main body.

4. The container lid according to claim 1, wherein the first elastic side wall is provided with a first upper side portion, a first middle portion, and a first lower side portion; the first upper side portion is connected to the top wall; the first middle portion is located between the first upper side portion and the first lower side portion; the second elastic side wall is provided with a second upper side portion, a second middle portion, and a second lower side portion; the second upper side portion is connected to the top wall; the second middle portion is located between the second upper side portion and the second lower side portion; a first spacing is reserved between the first upper side portion of the first elastic side wall and the second upper side portion of the second elastic side wall; a second spacing is reserved between the first middle portion of the first elastic side wall and the second middle portion of the second elastic side wall; and the first spacing is greater than the second spacing.

5. The container lid according to claim 4, wherein a third spacing is reserved between the first lower side portion of the first elastic side wall and the second lower side portion of the second elastic side wall, and the third spacing is greater than the second spacing.

6. The container lid according to claim 4, wherein a thickness of the first upper side portion is a first thickness; a thickness of the first lower side portion is a second thickness; and the second thickness is less than the first thickness.

7. The container lid according to claim 6, wherein a thickness of the second upper side portion is a third thickness; a thickness of the second lower side portion is a fourth thickness; and the fourth thickness is greater than the first thickness.

8. The container lid according to claim 4, wherein a cross section of the first elastic side wall is in a V shaped with a wide top and a narrow bottom.

9. The container lid according to claim 4, wherein the first lower side portion is provided with a first guide surface; and the second lower side portion is provided with a second guide surface.

10. The container lid according to claim 9, wherein the first guide surface is a cambered guide surface, and the second guide surface is an inclined guide surface.

11. The container lid according to claim 1, wherein the top wall is provided with an upper surface and a lower surface; the first elastic side wall and the second elastic side wall are connected to the lower surface; the upper surface is sunken towards the lower surface to form an accommodating slot; and the accommodating slot is configured to accommodate a container.

12. The container lid according to claim 1, wherein the lid main body is a silica gel lid main body or a rubber lid main body.

13. The container lid according to claim 1, wherein the first elastic side wall and the second elastic side wall are arranged in sequence in a direction from the center portion of the lid main body towards an edge portion of the lid main body.

14. The container lid according to claim 1, wherein each sealing raised line has a left side and a right side; the right side is connected to the first elastic side wall or the second elastic side wall; and the left side is configured to press and seal the container opening.

15. The container lid according to claim 14, wherein the left side has a fifth thickness; the right side has a sixth thickness; and the fifth thickness is less than the sixth thickness.

16. A container, comprising:

a container main body, wherein a side wall of the container main body is encircled to form an accommodating cavity; an upper end wall of the container main body is provided with a container opening; the container opening is communicated to the accommodating cavity; and a lid main body, wherein the lid main body comprises a top wall, a first elastic side wall extending from side edges of the top wall, and a second elastic side wall extending from the side edges of the top wall; the first elastic side wall and the second elastic side wall are encircled to form a sealing groove; the sealing groove is provided with a groove opening, wherein when the upper end wall of the container main body is placed in the sealing groove, the lid main body is covered at the container opening; and an inner wall of the sealing groove presses and seals the upper end wall of the container main body, so that the sealing groove presses and seals the container opening;

wherein the first elastic side wall and/or the second elastic side wall are provided with several elastic sealing raised lines, and the sealing raised lines are located in the sealing groove; and the sealing raised lines are configured to press and seal the container opening;

an inner wall of the sealing groove is oblique relative to a side surface of the second elastic side wall.

17. The container according to claim 16, wherein the first elastic side wall is provided with a first upper side portion, a first middle portion, and a first lower side portion; the first upper side portion is connected to the top wall; the first middle portion is located between the first upper side portion and the first lower side portion; the second elastic side wall is provided with a second upper side portion, a second middle portion, and a second lower side portion; the second upper side portion is connected to the top wall; the second middle portion is located between the second upper side portion and the second lower side portion; a first spacing is reserved between the first upper side portion of the first elastic side wall and the second upper side portion of the second elastic side wall; a second spacing is reserved between the first middle portion of the first elastic side wall and the second middle portion of the second elastic side wall; the first spacing is greater than the second spacing; a third spacing is reserved between the first lower side portion of the first elastic side wall and the second lower side portion of the second elastic side wall, and the third spacing is greater than the second spacing; the upper end wall is provided with a third upper side portion, a third middle portion, and a third lower side portion; the third middle portion is located between the third upper side portion and the third lower side portion; when the upper end wall of the container main body is placed in the sealing groove, the third upper side portion is located between the first upper side portion and the second upper side portion; an overflow gap is reserved between the third upper side portion and the first upper side portion and/or the second upper side portion; the third middle portion is located between the first middle portion and the second middle portion; the first middle portion and the second middle portion press and seal the third middle portion; and the third lower side portion is located between the first lower side portion and the second lower side portion.

18. The container according to claim 17, wherein the lid main body is a silica gel lid main body or a rubber lid main body, and a hardness range of the lid main body is 30-80 Shore A.

19. A container lid, comprising:

a lid main body, wherein the lid main body comprises a top wall, a first elastic side wall extending from side edges of the top wall, and a second elastic side wall extending from the side edges of the top wall; the first elastic side wall and the second elastic side wall are encircled to form a sealing groove; the sealing groove is provided with a groove opening; the sealing groove is configured to press and seal a container opening;

wherein the first elastic side wall and/or the second elastic side wall are provided with several elastic sealing raised lines, and the sealing raised lines are located in the sealing groove; and the sealing raised lines are configured to press and seal the container opening;

a length of the second elastic side wall in a thickness direction of the lid main body, is larger than that of the first elastic side wall.

* * * * *